US008116461B2

(12) United States Patent
L'Espérance et al.

(10) Patent No.: US 8,116,461 B2
(45) Date of Patent: Feb. 14, 2012

(54) SOUND VOLUME AUTOMATIC ADJUSTMENT METHOD AND SYSTEM

(75) Inventors: André L'Espérance, Quebec (CA); Alex Boudreau, Sherbrooke (CA); François Gariepy, Quebec (CA)

(73) Assignee: Soft DB Inc., Quebec (CA)

( * ) Notice: Subject to any disclaimer, the term of this patent is extended or adjusted under 35 U.S.C. 154(b) by 901 days.

(21) Appl. No.: 12/159,495

(22) PCT Filed: Dec. 10, 2007

(86) PCT No.: PCT/CA2007/002223

§ 371 (c)(1),
(2), (4) Date: Jun. 27, 2008

(87) PCT Pub. No.: WO2008/074127

PCT Pub. Date: Jun. 26, 2008

(65) Prior Publication Data

US 2009/0097665 A1 Apr. 16, 2009

Related U.S. Application Data

(60) Provisional application No. 60/870,517, filed on Dec. 18, 2006.

(51) Int. Cl.
*H04R 29/00* (2006.01)

(52) U.S. Cl. ..... 381/56; 381/26; 381/57; 381/58; 381/59; 381/77; 381/82; 381/83; 381/102; 381/104; 381/106

(58) Field of Classification Search ..... 381/26, 381/56–59, 77, 82, 83, 102, 104, 106–109, 381/122

See application file for complete search history.

(56) References Cited

U.S. PATENT DOCUMENTS

| | | | | |
|---|---|---|---|---|
| 4,438,526 | A | 3/1984 | Thomalla | |
| 5,666,426 | A * | 9/1997 | Helms | 381/57 |
| 2005/0232445 | A1 * | 10/2005 | Vaudrey et al. | 381/109 |
| 2006/0161283 | A1 * | 7/2006 | Chung | 700/94 |

FOREIGN PATENT DOCUMENTS

| | | |
|---|---|---|
| CA | 2122164 | 12/1995 |
| CA | 2438639 | 9/2002 |
| JP | 2000/148161 | 5/2000 |
| WO | WO 02/25631 | 3/2002 |

OTHER PUBLICATIONS

Acoustical Design of Conventional Open Plan Offices, Institue for research I Contruction, National Research Council Acoustic, vol. 27, No. 3 (2003)-23.

* cited by examiner

*Primary Examiner* — Tan N Tran
(74) *Attorney, Agent, or Firm* — Goudreau Gage Dubuc; Gwendoline Bruneau

(57) ABSTRACT

A control method to automatically adjust the volume of a sound transmitter based on the measurement and the computation of the acoustic statistics of the room where the sound is emitted. The system comprises at least one sensor, a calculator determining statistics of the signal collected by the at least one sensor and a controller using these statistics provided by the calculator to adjust the volume of the transmitter in the room.

16 Claims, 4 Drawing Sheets

SOUND VOLUME AUTOMATIC ADJUSTMENT METHOD AND SYSTEM

CROSS-REFERENCE TO RELATED APPLICATIONS

This application is a National Phase Application of PCT International Application no. PCT/CA2007/002223 filed on Dec. 10, 2007, which was published in English under PCT Article 21(2) as International Publication no. WO 2008/074127. This application further claims benefit of U.S. Provisional application No. 60/870,517, filed on Dec. 18, 2006. All documents above are incorporated herein in their entirety by reference.

FIELD OF THE INVENTION

The present invention relates to system and method for an automatic adjustment of the volume of sound in a space. More precisely, the present invention relates to an automatic sound volume adjustment method and system based on sound measurements and statistical analysis of the ambient noise in the space.

BACKGROUND OF THE INVENTION

In sound-masking applications, sound-masking systems are used to enhance speech privacy and comfort of workers in a working environment, for example. The principal of sound-masking is to increase the background noise of a room just enough to mask any distracting noise. The distracting noise generally comprises short acoustic events containing information, such as for example conversation, printer noise, telephone ring, etc. . . .

As sound-masking systems are being developed, it is now established that their efficiency is linked to their ability to emit an ideal masking sound spectrum with an adequate precision. The ideal masking sound is defined as achieving an optimized speech privacy at a listener's position for example (*Acoustical Design of Conventional Open Plan Offices*, Institute, for research I Construction, National Research Council, Canadian Acoustic, vol. 27. No. 3 (2003)-23).

Two parameters are mostly considered to obtain optimal privacy and comfort of workers, for example, with a sound-masking system: 1) the spectral shape of the masking sound and 2) the global level (or volume) of the masking sound.

To obtain the ideal spectral shape of the masking sound, the equalizer of the masking system is adjusted for each environment, taking into account a number of parameters including the size of the room, any coating on the walls of the room and the furniture in the room for example. The adjustment of the equalizer can be done manually. Automatic calibration systems are also known, as described for example in patent application US2006/0009969 A1 entitled "Auto-adjustment sound-masking system and method".

One the one hand, for an optimum efficiency, the global level, or volume, of the masking sound is also be set according to the dedication of the room: for instance, the level of sound-masking in the hall of a bank will typically be set to a higher level then the sound-masking level in the open office of clerical workers, while the sound-masking level in a closed office will be set lower.

On the other hand, for an optimum comfort, the sound-masking level is adjusted according to the intensity of the activity in the zone to be monitored: when the environment becomes quite, such as during outside office hours for instance, high level of masking sound is not necessary and, on the contrary, the sound-masking level may need to be reduced to provide an optimum comfort to any workers still present.

To meet such time variations, some sound-masking systems currently available on the market include a volume calendar that allows specifying the global level of the masking sound over time. This feature allows setting a lower masking sound outside office hours and a higher masking sound during periods of the day when noisy activities are expected for example. However, as such systems do not include retroaction on the real acoustical activity, a wrong global level of the masking sound related to the intensity of the activity in the room often results.

An alternative to a volume calendar is a dynamic controller using sensors located in the room for picking up the ambient noise and increasing the sound-masking levels when the ambient noise due to current activity increases. The input of the controller is the signal coming from microphones located in the room where the masking sound volume must be controlled. The global level measured at the microphones is thus used to obtain an acoustic activity rating and to determine the needed masking sound volume over time.

However, using a retroaction based on the global energy to adjust the masking sound volume can suffer from instability, since, if the controller increases the masking sound volume in response to the increase in the ambient noise, then the global levels measured by the controller's microphones increase and, based on these new higher global levels, the controller continues to increase the masking sound level.

In case of paging applications, the global energy control system is stable since the sound signal is non-steady, and for these applications, the volume adjustment is generally based on the background noise measured in between calls. Sound-masking systems generate a constant signal and the noise measurements always take into account the masking sound. Increasing the sound-masking signal results in a steady increase of the global energy in the room, making a global energy controller unstable or at least imprecise.

In summary, sound-masking levels must be adjusted with a great precision to be efficient while not distressing. For example, in an open office, sound-masking typically varies from 43-45 dBA (unit relating to the use of a frequency weighting to approximate the human ear's response to sound) during the quiet time of the day to a maximum of 48 dBA during the busy periods (see for example, *The Acoustical design of conventional open plan offices* Bradley, J. S., NRCC-46274 Canadian Acoustics, v. 31, no. 2, June 2003, pp. 23-31). Thus, even though a global energy controller is used to adjust the masking sound volume, due to their instability, they still fail to ensure a precise adjustment.

U.S. Pat. No. 4,438,526 to Thomalla, issued in 1984, discloses an automatic volume and frequency-controlled masking system. In this system, a masking sound is adjusted during emission thereof according to the noise measured by microphones in the room, to obtain a constant level and a target spectrum shape of the total noise (activity noise and masking sound, together) (see page 2, line 10). The technique used to obtain a constant noise level and a target spectrum shape in the room is based on a filtering operation done on the signals coming from the microphones. The output signals of the filters are used to determine the denominator of a divided circuit. When the total noise (noise due to the activity and sound emitted by the sound-masking system, together) in the room increases, the sound emitted by the masking sound speaker is reduced in order to obtain a constant total noise level and the target spectrum shape in the room. In this system, the masking sound is thus reduced when the noise levels due to the human activity in the room increase. The objective of this system is thus very different from that of an automatic volume controller for which the objective is to increase the masking sound when the distracting sound in the room increases. Note that the system described by Thomalla does not have the instability behavior of a standard global energy controller since the masking sound is reduced when the global noise in the room increases.

As of today, a stable controller for an automatic adjustment of the masking sound volume still remains a technical challenge. Canadian patent Application CA 2, 122, 164 by A. Singmin teaches monitoring the ambient background noise to automatically adjust the volume of a white noise stimulator (generator), thereby eliminating the need to continually make a manual adjustment of the masking sound. However, this document fails to explain how the system operates and how it overcomes the instability problem.

More recently, R. Goubran and R. Botos teach an adaptive sound-masking system (US 2003/0103632 A1), based on increasing the noise level and frequency content of the masking sound according to the ambient noise. More precisely, an adaptive sound-masking system divides the sound to be masked into time-blocks and estimates the frequency spectrum and the global level, and continuously generates a white noise with a matching spectrum and global level to mask the undesired sound. In this system, the scaling factor of the amplifier is based on the standard energy controller. To avoid instability problem, the microphone is located in a first region and the speaker is located in a second region, which may limit the application of this system since the masking speaker can not be in the same region (i.e. room) where undesired sound is measured. Moreover, the system described is based on a fast adaptation rate (every 50 ms) of the masking level according to the disturbance noise (speech, phone).

Therefore, there is still a need in the art for a sound automatic volume adjustment method and system.

SUMMARY OF THE INVENTION

More specifically, there is provided a system for automatic sound volume adjustment of a room provided with a sound transmitter, comprising an acquisition unit collecting data representative of the sound in the room, a calculator global evaluator computing global level statistics of these data, and a controller, the controller using global levels provided by the calculator to adjust the volume of the sound emitted by the transmitter in the room.

There is further provided a method for automatic sound volume adjustment in a room provided with a sound transmission unit, comprising obtaining data representative of the sound in the room; determining global level statistics of the data; and using the statistics to adjust a volume of the sound emitted by the sound transmission unit in the room.

There is further provided a system.

Other objects, advantages and features of the present invention will become more apparent upon reading of the following non-restrictive description of embodiments thereof, given by way of example only with reference to the accompanying drawings.

DESCRIPTION OF EMBODIMENTS OF THE INVENTION

Figure 1:
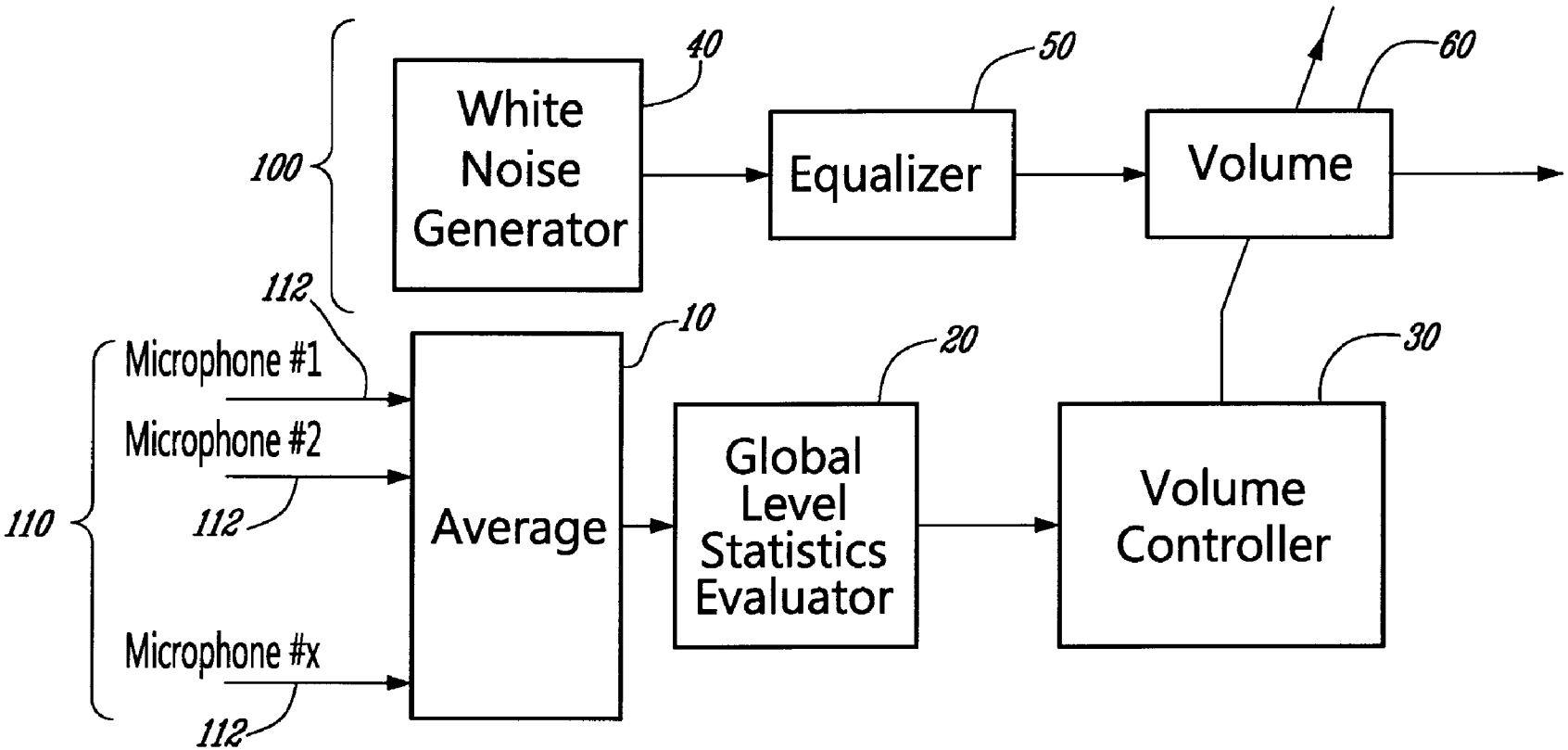
FIG. 1 illustrates a system according to an embodiment of an aspect of the present invention.

There is provided a system allowing the automatic adjustment of the volume of a sound emitted by a transmitter, based on the measurement of the sound and the computation of acoustical statistics of the room where the transmitter is installed.

There is provided an automatic adjustment method of the volume emitted by a transmitter, based on the measurement of the sound and the computation of the acoustical statistics of the room where the transmitter is installed.

In the following description the transmitter will be exemplified by a sound-masking system, for illustrative example.

The transmitter is here exemplified as a sound-masking unit (100), typically including a masking sound generator (40), an equalizer (50), a power amplifier and at least one loudspeaker (60).

In a room equipped with such a sound-masking unit (100), an acquisition unit (110) is used for collecting signals coming from at least one sensor located in the room. The sensor may be a microphone, or a plurality of microphones (112) located in the room, for example, collecting sound signals in the room. Other types of sensors may be contemplated, such as a camera video collecting images of the room and, in association with a software, yielding acoustic signals corresponding to the activity as captured on video, for example.

In case of a plurality of sensors such as microphones (112) as illustrated in FIG. 1, the acquisition unit (110) may comprise a module for averaging (10) the signals collected by the various sensors.

The acquisition unit (110) further comprises a calculator, referred to as a global level statistics evaluator (20) in FIG. 1 for example, to compute global level statistics of the signal collected by the sensor, or of the averaged signal in case of a plurality of sensors, as discussed hereinabove.

As people in the art will appreciate, the calculator may be a digital signal processor (DSP) using digital signals from an analog-to-digital converter (ADC) converting analog signal (s) collected in the room, as known in the art.

The acquisition unit (110) further comprises a controller (30), which uses these global levels to adjust the volume (60) of the sound-masking unit (100).

More precisely, the global level statistics evaluator (20) uses the collected signal (or averaged signal in case of a plurality of sensors) to compute an instant global level over a fixed short time period, typically less than 1 second. The global level statistics evaluator (20) computes the background noise level and the global level of short acoustic events, and yields statistics by compiling all instant global levels for the fixed time period. The difference between the background noise and the short acoustic events global levels allows the volume controller (30) determining an error in comparison with a set point. The set point is the desired difference between the background noise global level and the global level of the short acoustic events (informational noise).

The error computed by the volume controller (30) can be used directly to adjust the volume of the sound emitted by the sound-masking unit (100), since there is a direct correlation between the background noise and the masking sound volume.

A volume saturation module with a low limit and a high limit, which will be further discussed hereinbelow in relation to FIG. 4, may further allow specifying an operation range for the masking sound volume.

A method according to an embodiment of a further aspect of the invention will now be described, using as step numbers the reference labels of corresponding components of the system described hereinabove.

The method generally comprises collecting data about the sound in a room; calculating the statistics of these data; and, based on these statistics, adjusting the volume of a sound to be added in the room by the transmitter.

Figure 2:
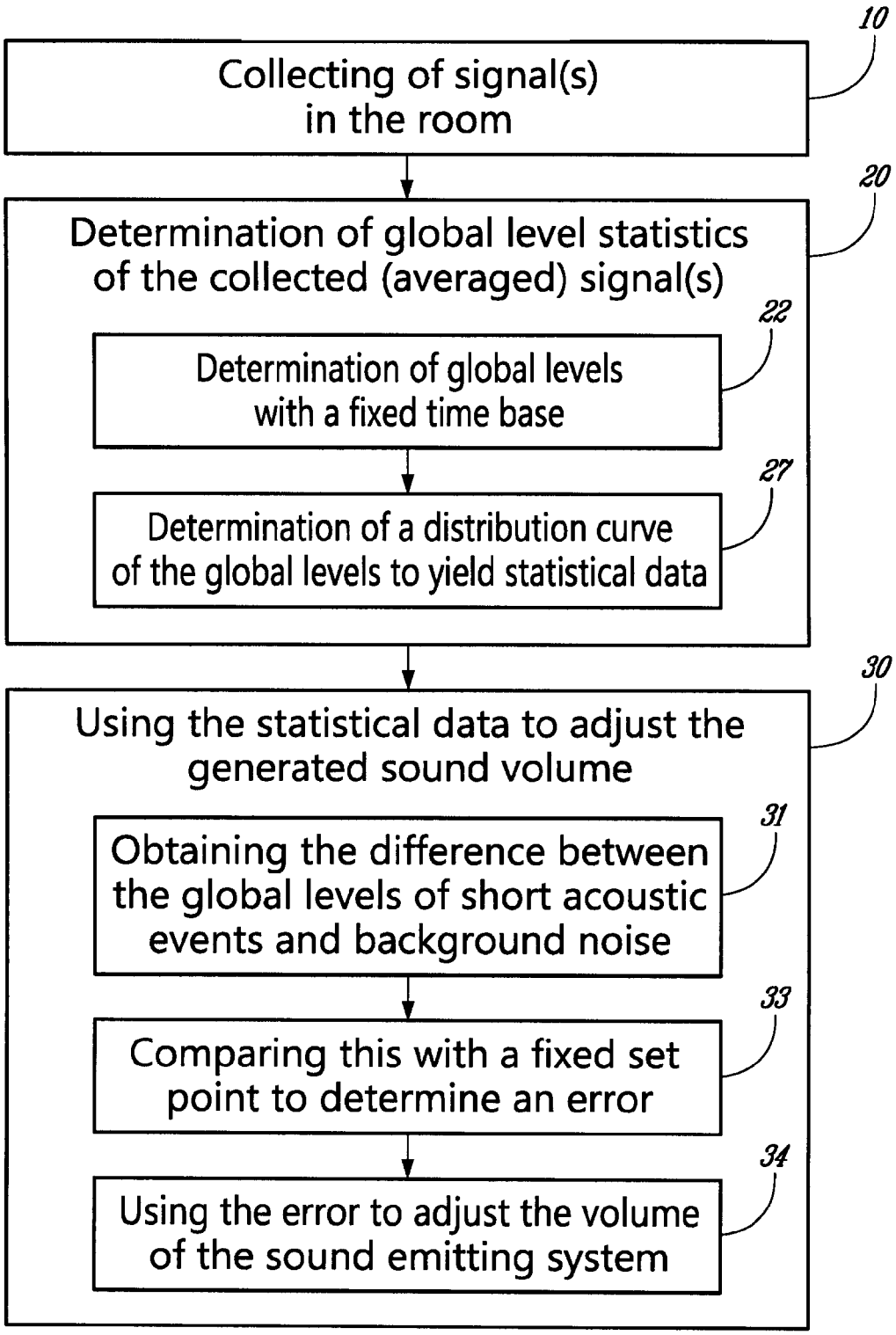
FIG. 2 is a flowchart of a method according to an embodiment of another aspect of the present invention.

For example, as illustrated in FIG. 2, in step 10, signal(s) coming from microphones located in the room are collected and averaged by a module for averaging the collected signals (10), in the case when a plurality of data sources are used to obtain an improved spatial representation of the acoustic activity in the room. Indeed, as well known in the art, the use of an average of signals collected in the room allows obtaining a precise spatial representation of the acoustical activity in the room.

Figure 3:
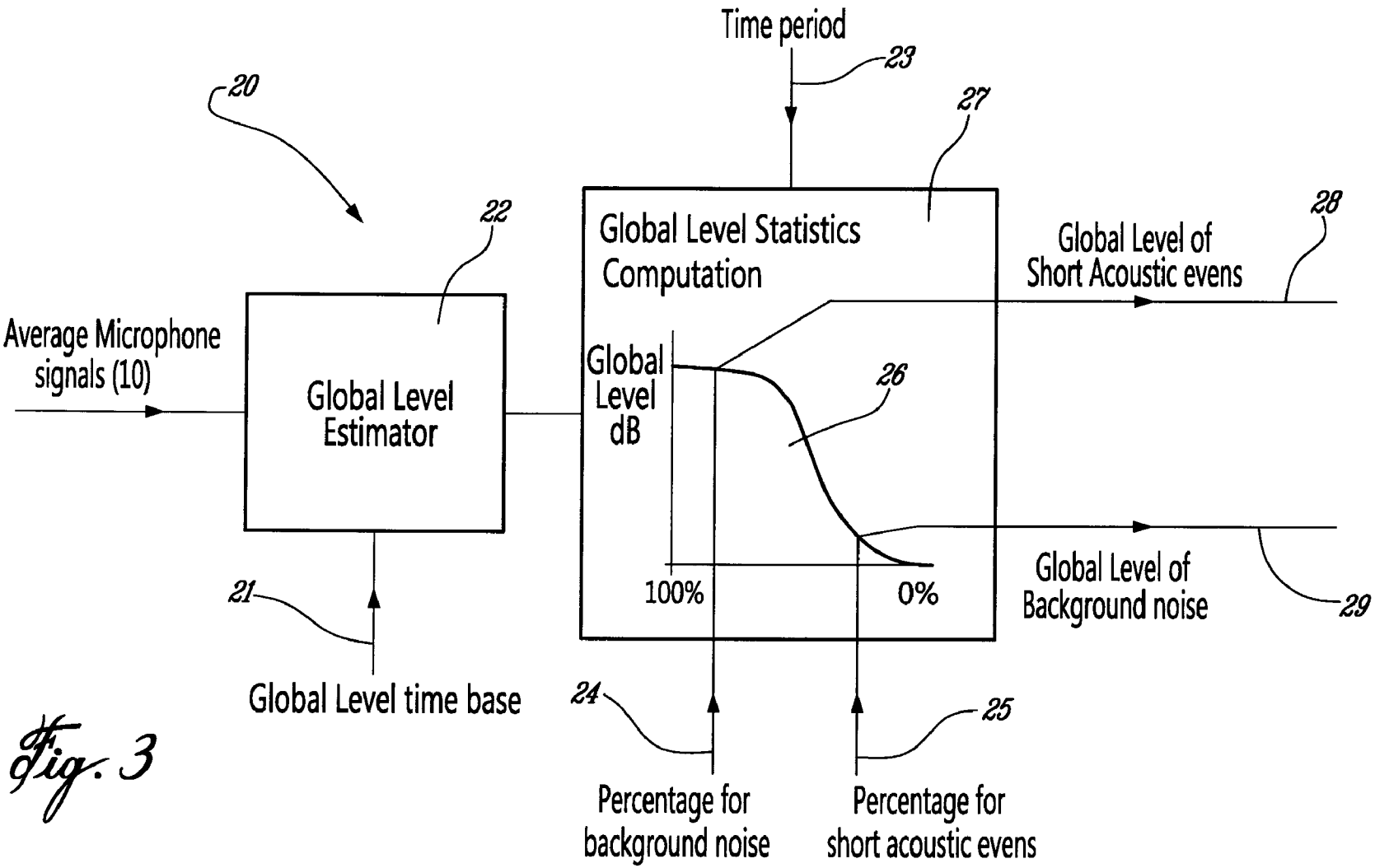
FIG. 3 illustrates details of a global level statistic evaluator of the system of FIG. 1.

In step 20, the global level statistics of the averaged signal coming from the module (10) are computed by a global level statistics evaluator (20), as detailed in FIG. 3.

As shown in FIG. 3, the global levels are computed by a global level estimator (step 22) with a fixed time base (21). The time base used to compute the global level is short, typically under 1 second. Then, a distribution curve of the global levels (26) is computed (step 27) to extract the global levels for both short acoustic events (28) and the background noise (29), which will be discussed hereinbelow.

More precisely, the distribution curve computed at step 27 is determined with all global levels computed by the global level estimator in step 22 over a fixed time of period (23). This fixed time of period (23) may be adjusted to allow a faster or slower response of the overall control. The distribution curve represents the global levels in function of a percentage. For a given global level on the distribution curve, the corresponding percentage means that the global level (or lower global levels) are measured at this percentage of time (23).

Two values may be extracted from the distribution curve: 1) the global level of the short acoustic events (28) and 2) the global level of the background noise (29). The global level for the short acoustic events (28) is read on the distribution curve at a percentage specified by a value referred to as a percentage for the short acoustic events (25). The global level for the background noise (28) is read on the distribution curve at a percentage specified by a value referred to as a percentage for background noise (24). Percentage values used to read the global level for short acoustic events and the background noise of respectively 10% and 90% for example are found to yield an adequate control level, in the case of a sound-masking system for example.

Figure 4:
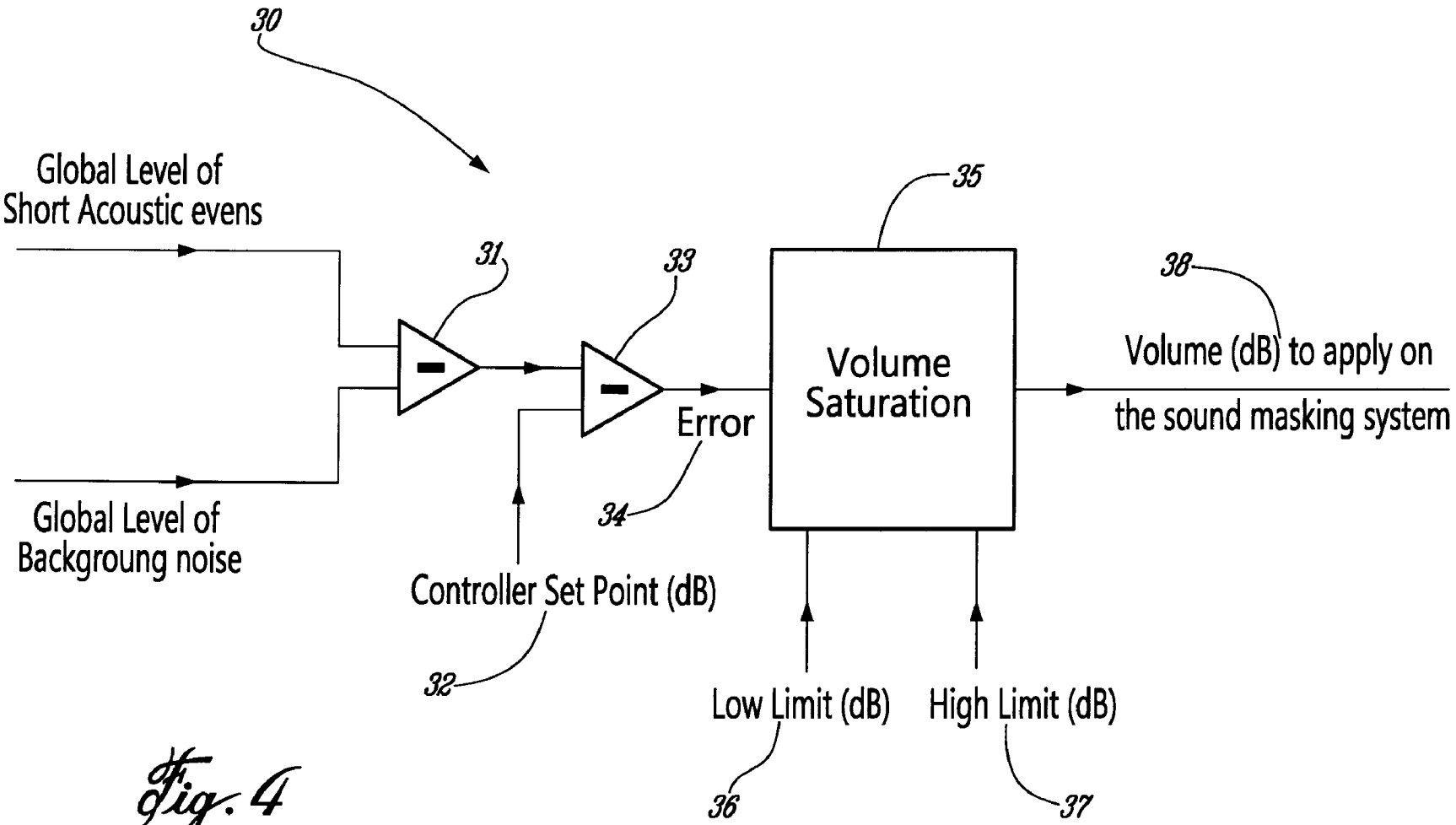
FIG. 4 illustrates details of a volume controller of the system FIG. 1.

In step 30, the statistical data (28, 29) are used by the volume controller (30) to adjust the volume of the sound emitted by the sound-masking unit (100) (see FIG. 1), as detailed in FIG. 4.

As illustrated in FIG. 4, the volume controller (30) uses the global levels of short acoustic events (28) and background noise (29) computed by the global level statistics evaluator (20) to compute an adequate volume of the sound-masking unit (100).

More precisely, the controller (30) computes the difference between the global levels of short acoustic events and background noise (step 31). Then, this difference is compared (step 33) with a fixed set point (32) to determine an error (34). The set point (32) is a desired difference between the background noise and global level of short acoustic events. Since the contribution of the masking sound on the background noise is direct, the error (34) can be used to adjust the volume of the sound-masking unit (step 34).

The controller (30) allows adjustment of the masking sound volume in the same region where the noise measurements are taken. Moreover, the adaptation can be done on longer periods (from couple of seconds to few minutes) to avoid rapid variations of the masking sound levels, which can otherwise be a nuisance for the workers in the room for example.

As illustrated in FIG. 4, a volume saturation module (35) may be used by the volume controller (30) to limit the masking sound volume to a desired range, by specifying a low limit (line 36) and a high limit (line 37) to the volume controller (30).

As people in the art will appreciate, the use of global level statistics allows overcoming the stability problem. In the present method, the controller is able to make the distinction between the background noise and the short acoustic events related to the activity in the room, and therefore to extract the masking sound from the noise to be masked, in the measurements. Since the contribution of the masking sound unit to the background noise is direct, the controller is thus able to distinguish the information due to the masking sound from the information due to the sound to be masked, which results in a stable control system.

Furthermore, the use of the difference between global levels of background noise and short acoustic events to automatically compute the adequate volume of the sound-masking unit to obtain the desired set point allows avoiding the calibration of the signals coming from the microphones. In fact, whatever the reference used to compute the global levels in dB, the difference stays the same.

The use of a volume saturation module further allow defining a range for the volume to respect the limitation of the amplifier stage (60) of the sound-masking unit (100), for an increased comfort of the persons in the monitored room for example, in case of a problem with the control system (erratic microphone signals, loud background noise which is not associated with the sound-masking unit, etc. . . . ).

The present system and method, with a speed satisfactory to track evolution of ambient noise during time, allows precise adjustment of the volume of the generated sound at about 0.5 dB in retroaction to the ambient noise.

Due to the higher precision allowed by the present statistical controller, as people in the art will appreciate, the present system and method may be applied to a range of transmitters emitting a constant sound. They may further be applied to non-constant sound transmitters, such as a TV set in a waiting room, a music player in a ballroom, etc, providing modifying control parameters, i. e the percentages values used on the distribution curve described hereinabove, for example.

Although the present invention has been described hereinabove by way of embodiments thereof, it may be modified, without departing from the nature and teachings of the subject invention as described hereinabove

What is claimed is:

1. A system for automatic sound volume adjustment of a room provided with a sound transmitter, comprising:

an acquisition unit, said acquisition unit collecting data representative of the sound in the room;

a calculator global evaluator computing global level statistics of said data; and a controller;

wherein said controller uses global levels provided by said calculator to adjust the volume of the sound emitted by the transmitter in the room.

2. The system of claim 1, wherein said calculator determines the global level statistics with a fixed time base, and a distribution curve of the global levels to yield statistical data; said controller using the statistical data to adjust the volume of the sound emitted by the transmitter.

3. The system of claim 1, wherein said calculator computes a background noise level and a global level of short acoustic events, and yields statistics, said controller obtaining a difference between the global level of short acoustic events and the background noise level, comparing said difference with a fixed set point to determine an error, and uses said error to adjust the volume of the sound emitted by the transmitter.

4. The system of claim 1, further comprising a volume saturation module, said controller using said volume saturation module to limit the volume of the sound emitted by the transmitter to a desired range.

5. A method for automatic sound volume adjustment in a room provided with a sound transmission unit, comprising the acts of:

a) obtaining data representative of the sound in the room;

b) determining global level statistics of the data; and c) using the statistics to adjust a volume of the sound emitted by the sound transmission unit in the room.

6. The method of claim 5, wherein said step a) comprises collecting signals from at least one microphone located in the room.

7. The method of claim 5, wherein said step b) comprises computing global levels with a fixed time base; and extracting the global levels for both short acoustic events and a background noise.

8. The method of claim 7, wherein the fixed time base is under 1 second.

9. The method of claim 5, wherein said step b) comprises computing global levels with a fixed time base; obtaining a distribution curve of the global levels; and extracting the global levels for both short acoustic events and a background noise from the distribution curve; and said step c) comprises using the global levels for short acoustic events and the global levels for background noise to determine an adequate volume of the sound transmission unit.

10. The method of claim 5, wherein said step b) comprises computing global levels with a fixed time base; obtaining a distribution curve of the global levels; and extracting the global levels for both short acoustic events and a background noise from the distribution curve; and said step c) comprises computing a difference between the global levels of short acoustic events and background noise; comparing the difference with a fixed set point to determine an error; and using the error to adjust the volume of the sound transmission unit.

11. The method of claim 5, further comprising the step of limiting the volume of the sound transmission unit.

12. A controller for automatic sound level control of a space, comprising:

a sound transmission unit located in said space;

an acquisition unit;

a calculator; and a controller;

wherein said acquisition unit collects sound signals in said space, said calculator computes global level statistics from an average of said signals; and said controller uses said global level statistics to adjust the volume of the sound transmission unit.

13. A method for automatic sound volume adjustment in a room provided with a sound transmission unit, comprising the acts of:

c) obtaining data representative of the sound in the room;

d) determining global level statistics of the data; and c) using the statistics to adjust a volume of the sound emitted by the sound transmission unit in the room;

wherein said step b) comprises computing global levels with a fixed time base; and extracting the global levels for both short acoustic events and a background noise.

14. The method of claim 13, wherein the fixed time base is under 1 second.

15. A method for automatic sound volume adjustment in a room provided with a sound transmission unit, comprising the acts of:

e) obtaining data representative of the sound in the room;

f) determining global level statistics of the data; and c) using the statistics to adjust a volume of the sound emitted by the sound transmission unit in the room;

wherein said step b) comprises computing global levels with a fixed time base; obtaining a distribution curve of the global levels; and extracting the global levels for both short acoustic events and a background noise from the distribution curve; and said step c) comprises using the global levels for short acoustic events and the global levels for background noise to determine an adequate volume of the sound transmission unit.

16. A method for automatic sound volume adjustment in a room provided with a sound transmission unit, comprising the acts of:

g) obtaining data representative of the sound in the room;

h) determining global level statistics of the data; and c) using the statistics to adjust a volume of the sound emitted by the sound transmission unit in the room;

wherein said step b) comprises computing global levels with a fixed time base; obtaining a distribution curve of the global levels; and extracting the global levels for both short acoustic events and a background noise from the distribution curve; and said step c) comprises computing a difference between the global levels of short acoustic events and background noise; comparing the difference with a fixed set point to determine an error; and using the error to adjust the volume of the sound transmission unit.

* * * * *